US010765895B2

(12) United States Patent
Wang et al.

(10) Patent No.: US 10,765,895 B2
(45) Date of Patent: Sep. 8, 2020

(54) FALL PROTECTION DEVICE AND SAFETY BELT BASE THEREOF

(71) Applicant: YOKE INDUSTRIAL CORP., Taichung (TW)

(72) Inventors: Jyu-Yi Wang, Changhua (TW); Wei-Chieh Hung, Taichung (TW)

(73) Assignee: YOKE INDUSTRIAL CORP., Taichung (TW)

( * ) Notice: Subject to any disclaimer, the term of this patent is extended or adjusted under 35 U.S.C. 154(b) by 85 days.

(21) Appl. No.: 16/193,976

(22) Filed: Nov. 16, 2018

(65) Prior Publication Data

US 2020/0078618 A1 Mar. 12, 2020

(30) Foreign Application Priority Data

Sep. 11, 2018 (TW) ..... 107131929 A

(51) Int. Cl.
*A62B 35/00* (2006.01)
*B65H 75/40* (2006.01)
*B65H 75/44* (2006.01)

(52) U.S. Cl.
CPC ..... *A62B 35/0093* (2013.01); *B65H 75/40* (2013.01); *B65H 75/4442* (2013.01)

(58) Field of Classification Search
CPC ..... A62B 1/08; A62B 1/10; A62B 35/0093; B65H 75/40; B65H 75/4442
See application file for complete search history.

(56) References Cited

U.S. PATENT DOCUMENTS 4,480,716 A * 11/1984 Soubry ..... A62B 1/12 182/233
4,877,110 A * 10/1989 Wolner ..... A62B 35/0093 182/232

(Continued)

FOREIGN PATENT DOCUMENTS

EP 2845626 B1 8/2018
TW M497029 U 3/2015

(Continued)

OTHER PUBLICATIONS

Examination Report for TW107131929, dated Apr. 24, 2019, Total of 3 pages.

(Continued)

*Primary Examiner* — Colleen M Chavchavadze
(74) *Attorney, Agent, or Firm* — Tracy M. Heims; Apex Juris, pllc.

(57) ABSTRACT

A fall protection device and its safety belt base. The fall protection device adapted to be connected to a safety belt includes a frame, a shaft, and a safety belt base, wherein the frame has a receiving place. The shaft is disposed on the frame. The safety belt base fits around the shaft and is located in the receiving place. The safety belt base includes a first portion and a second portion. The first portion has a ring, and the second portion has a sleeve and a reinforcement portion connected to the sleeve. The sleeve is surrounded by the ring and is adapted to be connected to the safety belt. The reinforcement portion is embedded in the ring. With the reinforcement portion, the structural strength of the safety belt base could be reinforced, and the first portion and the second portion could be prevented from disengaging from each other.

6 Claims, 7 Drawing Sheets

(56) References Cited

U.S. PATENT DOCUMENTS

| | | | | |
|---|---|---|---|---|
| 5,186,289 | A * | 2/1993 | Wolner | A62B 1/12 182/232 |
| 7,237,651 | B2 * | 7/2007 | Avots | A62B 1/10 182/234 |
| 7,281,620 | B2 * | 10/2007 | Wolner | A62B 1/10 192/223.1 |
| 7,780,146 | B2 * | 8/2010 | Casebolt | A62B 1/10 254/346 |
| 8,181,744 | B2 * | 5/2012 | Parker | A62B 1/10 182/232 |
| 8,490,750 | B2 * | 7/2013 | Balquist | A62B 35/0093 182/231 |
| 8,701,833 | B2 * | 4/2014 | Marquardt | A62B 1/10 182/231 |
| 8,863,898 | B2 | 10/2014 | Harris, Jr. | |
| 9,121,462 | B2 * | 9/2015 | Casebolt | A62B 1/10 |
| 9,199,103 | B2 * | 12/2015 | Hetrich | A62B 1/10 |
| 9,861,841 | B1 * | 1/2018 | Hung | A62B 35/0093 |
| 10,391,339 | B2 * | 8/2019 | Sun | A62B 35/0093 |

FOREIGN PATENT DOCUMENTS

| | | | |
|---|---|---|---|
| TW | I574715 | B | 3/2017 |
| TW | 201739484 | A | 11/2017 |
| TW | M571747 | U | 12/2018 |

OTHER PUBLICATIONS

Search Report for TW107131929, dated Apr. 24, 2019, Total of 1 page.
English Abstract for TW201739484, Total of 1 page.
English Abstract for TWM497029, Total of 1 page.
English Abstract for TWM571747, Total of 1 page.
English Abstract for TWI574715, Total of 1 page.

* cited by examiner

FALL PROTECTION DEVICE AND SAFETY BELT BASE THEREOF

BACKGROUND OF THE INVENTION

Technical Field

The invention relates generally to a fall protection device, and more particularly to a fall protection device with strong structure and durable feature and its safety belt base.

Description of Related Art

Generally, those who work at an elevated work site, such as roof, factory, elevator, shipyard, aerospace base and construction site, and etc., will equip with safety parts such as a fall protection device (i.e. a fall arrest device). The fall protection device usually mates with a safety belt and it is adapted with the safety belt, wherein an end of the safety belt is attached to a user. Thereby, as long as the user accidentally falls from the elevated work site, the fall protection device could provide a quick-lock action or slow down the speed of the unwinding safety belt. It ensures the user's safety by preventing the user from keeping falling or slowing down the user's falling speed.

Taiwan patent number 1574715 discloses a fall protection device, wherein a safety belt 200 is wound around a rolling drum 40. When the safety belt 200 is pulled out from the rolling drum 40 by the user who falls accidentally, the pulling force destroys the structure of a ring 46 and a sleeve 44 of the rolling drum 40. For example, the ring 46 may be broken or be separated from the sleeve 44 due to being unendurable to the suddenly strong pulling force. As a result, the fall protection device may lose the function of braking.

BRIEF SUMMARY OF THE INVENTION

In view of the above, the objective of the present invention is to provide a fall protection device and its safety belt base, wherein the safety belt base for wrapping a safety belt has a special structural design to reinforce its structure.

To achieve the above object of the present invention, the present invention provides a fall protection device adapted to be connected to a safety belt, wherein the fall protection device includes a frame, a shaft, and a safety belt base. The frame has a receiving place. The shaft is disposed on the frame. The safety belt base is fitted around the shaft and is located in the receiving place. The safety belt base includes a first portion and a second portion, wherein the first portion has a ring. The second portion has a sleeve and a reinforcement portion, wherein the sleeve is surrounded by the ring and is adapted to be connected to the safety belt. The reinforcement portion is embedded within the ring.

To achieve the above object of the present invention, the present invention provides a safety belt base. The safety belt base is adapted to be disposed in a fall protection device and includes a first portion and a second portion, wherein the first portion has a ring and is adapted to be wrapped by a safety belt. The second portion has a sleeve and a reinforcement portion connected to the sleeve, wherein the sleeve is surrounded by the ring and is adapted to be connected to the safety belt. The reinforcement portion is embedded within the ring.

With the reinforcement portion buried within the sleeve of the safety belt base, the first portion and the second portion could be firmly fixed together and could not break apart easily.

BRIEF DESCRIPTION OF THE A PLURALITY OF VIEWS OF THE DRAWINGS

The present invention will be best understood by referring to the following detailed description of some illustrative embodiments in conjunction with the accompanying drawings, in which FIG. 1 is a perspective view of the fall protection device of an embodiment according to the present invention;

DETAILED DESCRIPTION OF THE INVENTION

Figure 1:
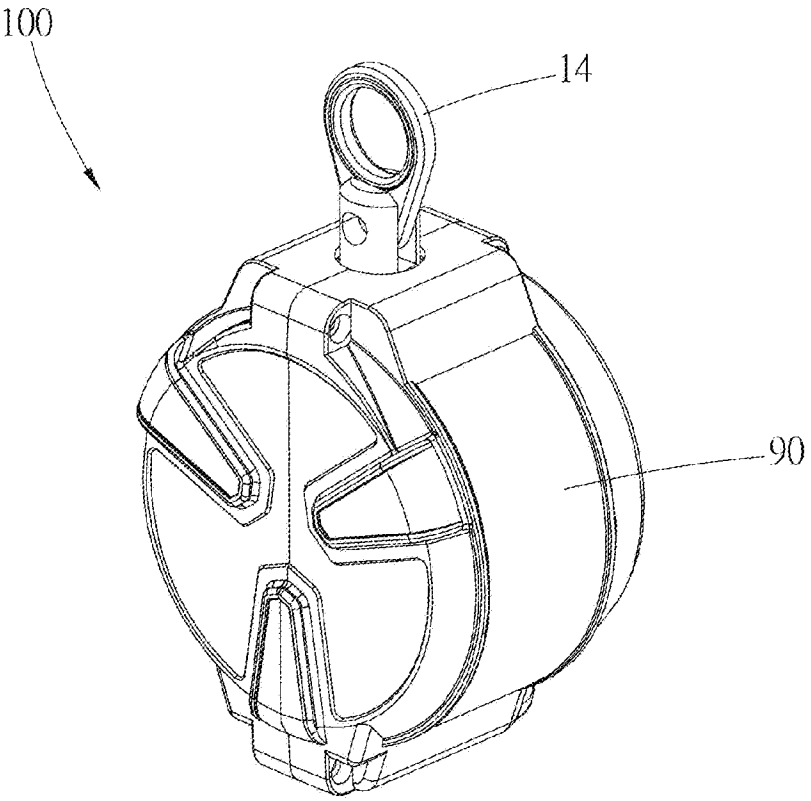
Figure 2:
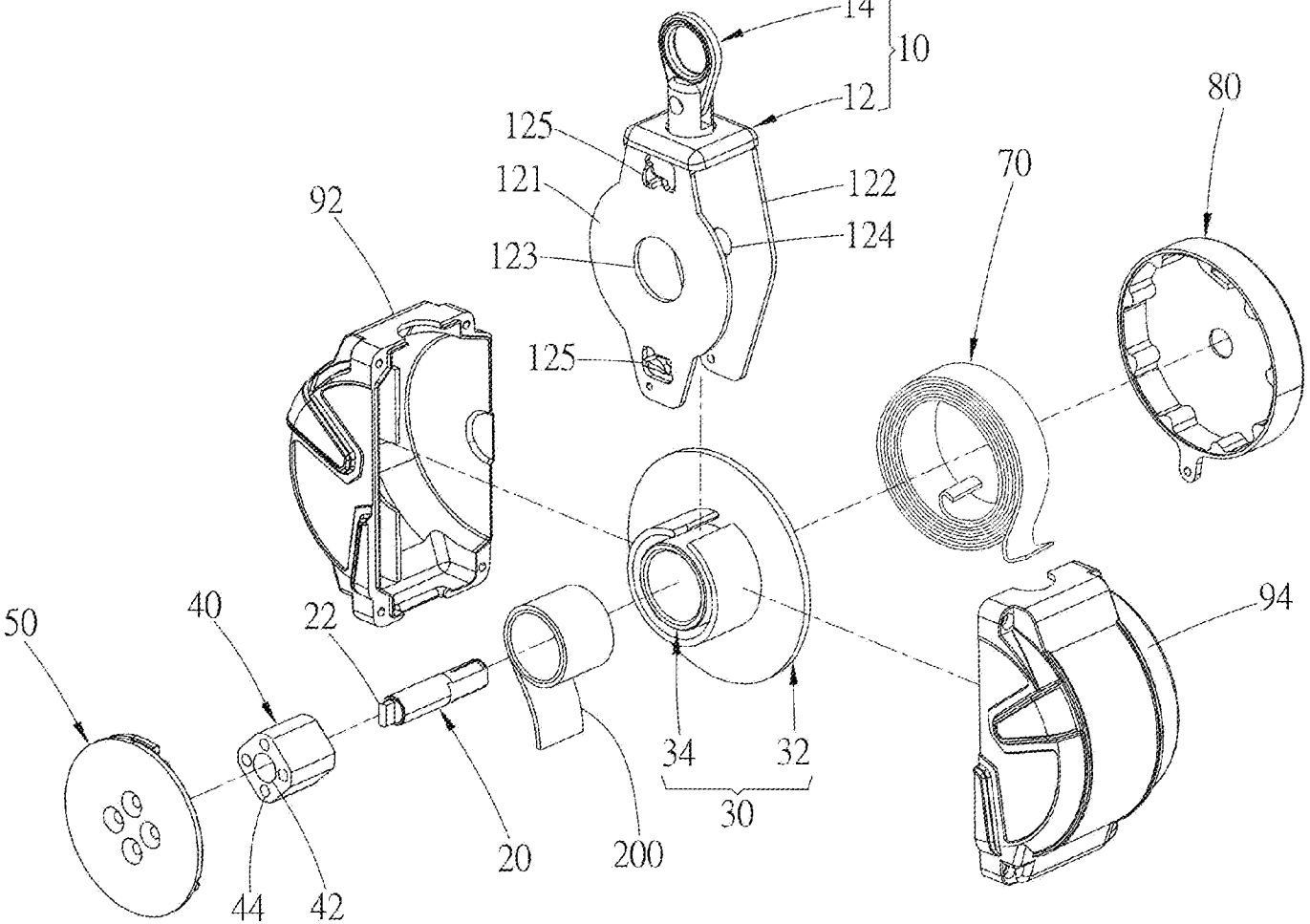
FIG. 2 is an exploded view of the fall protection device according to the embodiment shown in FIG. 1
Figure 3:
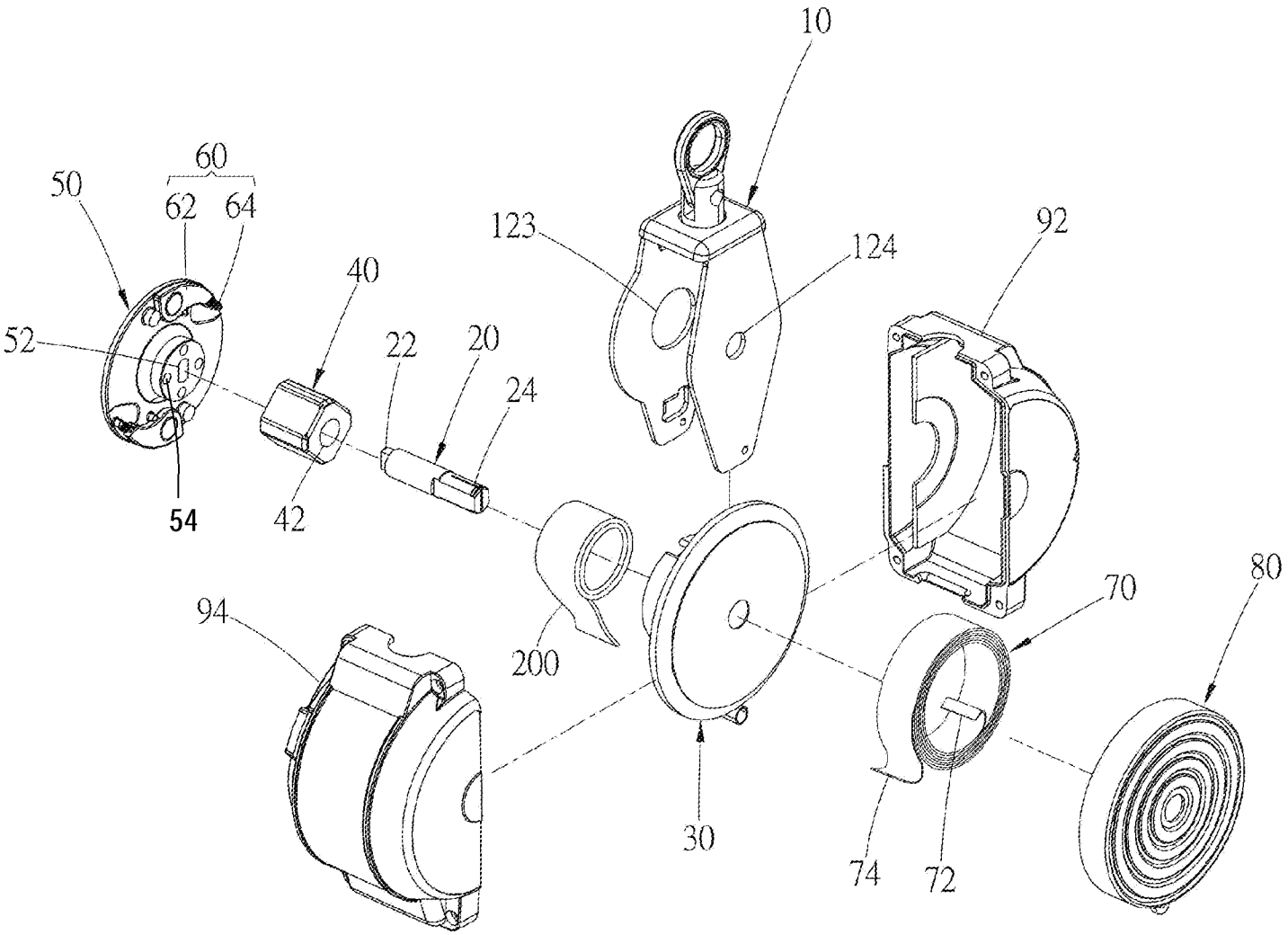
FIG. 3 is an exploded view of the fall protection device according to the embodiment shown in FIG. 1.

A fall protection device 100 according to an embodiment of the present invention is shown in FIG. 1 to FIG. 7, wherein the fall protection device 100 is adapted to be connected to a safety belt 200 and includes a frame 10, a shaft 20, and a safety belt base 30. In the current embodiment, the fall protection device 100 further includes a decelerating member 40, a braking plate 50, a braking assembly 60, a spiral spring 70, a lateral cover 80, and a housing 90.

The frame 10 includes a frame body 12 and a hanging ring 14 which is engaged with a top of the frame body 12. The frame body 12 forms a receiving place. The frame body 12 has two side plates 121, 122 which face each other. Two perforations 123, 124 are respectively and correspondingly disposed on the side plates 121, 122. Moreover, one of the side plates (i.e., the side plate 121) has a blocking portion 125. Preferably, in the current embodiment, the side plate 121 has two blocking portions 125. The hanging ring 14 is adapted to be connected to or be fixed on a stable support as a pivot. The support could be a cable or a post, etc. However, the support is not limited to the examples given above.

The shaft 20 is disposed on the frame 10. In the current embodiment, two ends of the shaft 20 penetrate through the perforations 123, 124 of the side plates 121, 122 respectively.

Figure 4:
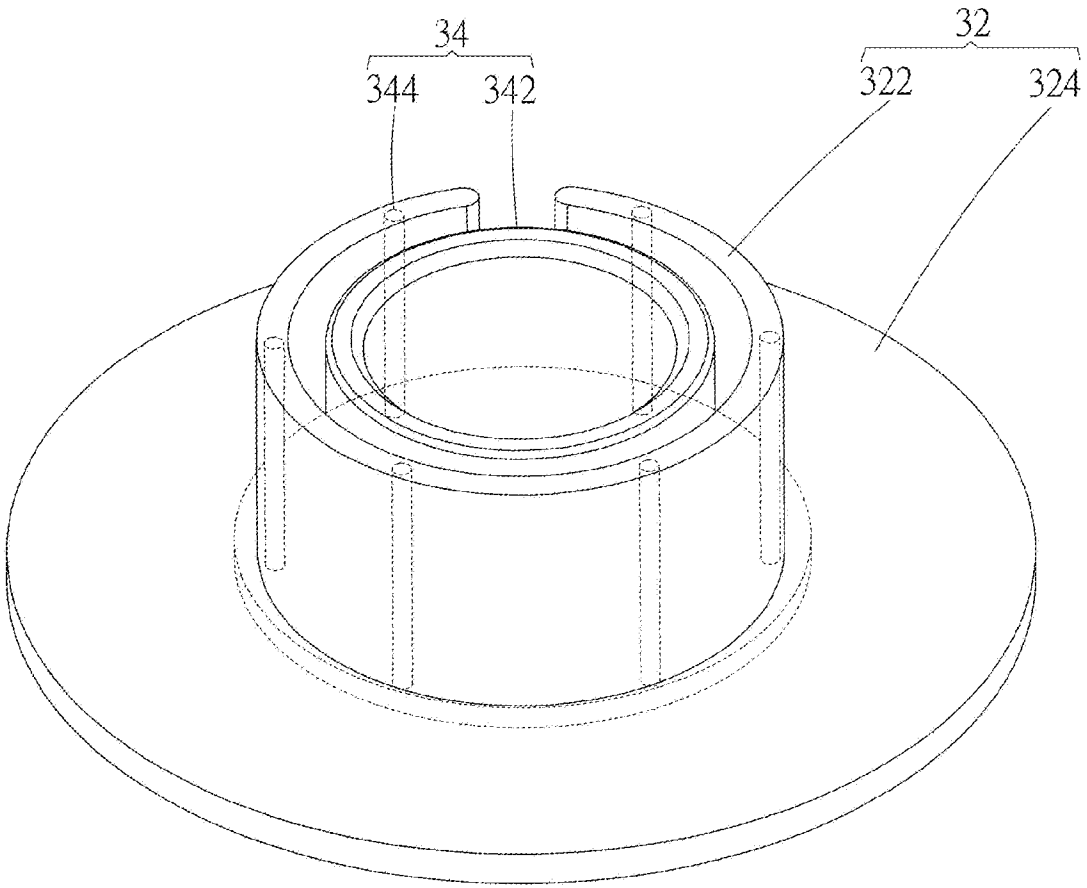
FIG. 4 is a perspective view of the safety belt base of the fall protection device according to the embodiment shown in FIG. 1, disclosing the reinforcement portion is embedded within the ring.
Figure 5:
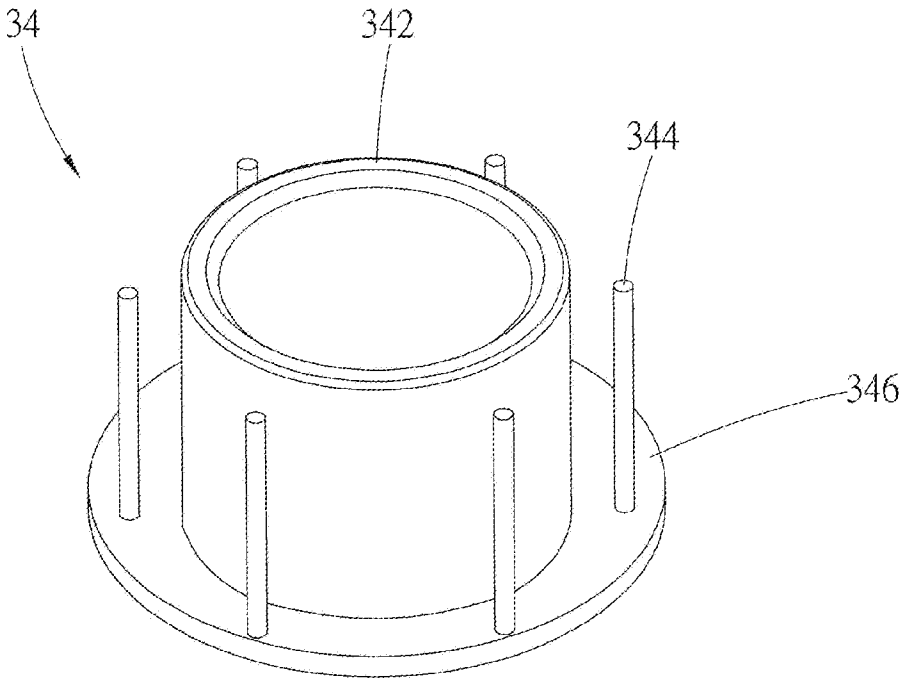
FIG. 5 is a perspective view of the second portion of the fall protection device according to the embodiment shown in FIG. 1.
Figure 7:
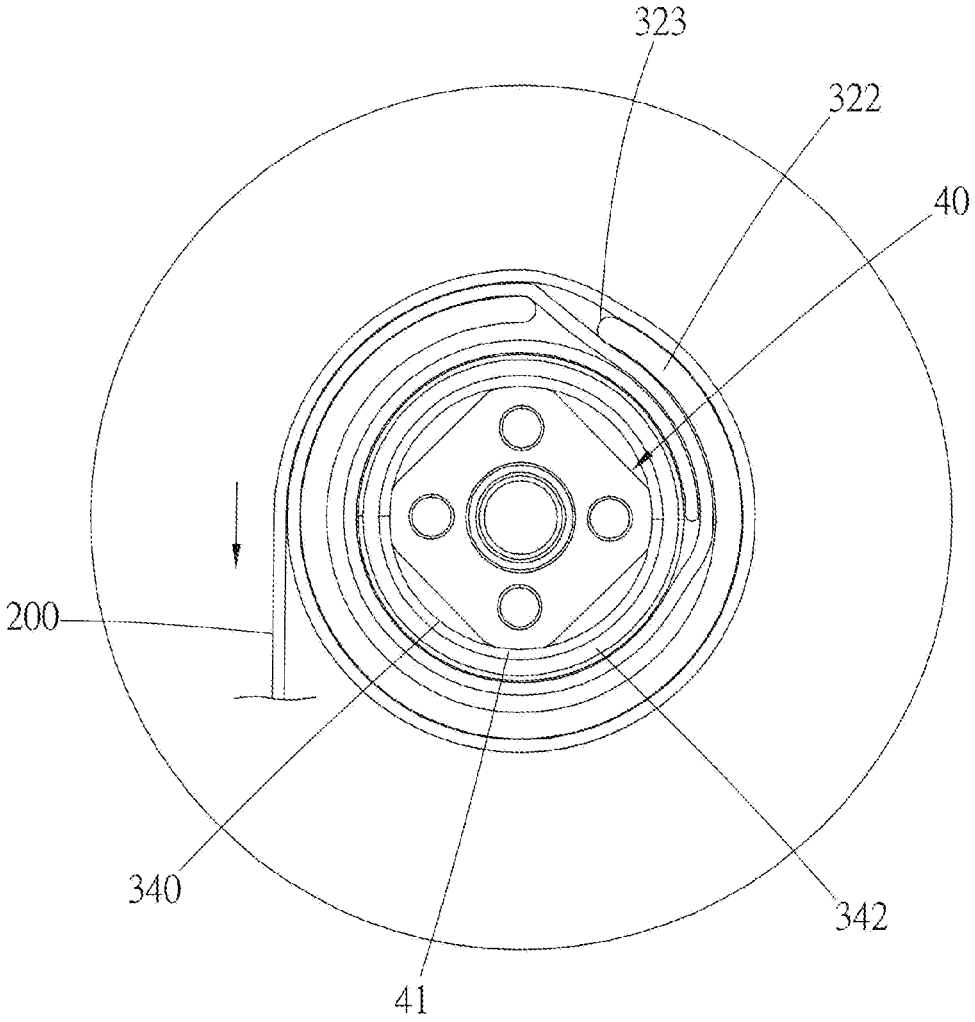
FIG. 7 is a side view, disclosing the relationship among the decelerating member, the safety belt base, and the safety belt.

The safety belt base 30 fits around the shaft 20 and is located in the receiving place. The safety belt base 30 has a first portion 32 and a second portion 34. As shown in FIG. 4 and FIG. 5, the first portion 32 has a ring 322, and the second portion 32 has a sleeve 342 and a reinforcement portion connected to the sleeve 342. The sleeve 342 is surrounded by the ring 322 and is adapted to be connected to the safety belt 200. The reinforcement portion is embedded within the ring 322. In the current embodiment, the reinforcement portion includes a plurality of pillars 344. The pillars 344 are set at intervals within the ring 322. Moreover, the first portion 32 further includes a first base plate 324, wherein a side of the first base plate 324 is connected to the ring 322; the second portion 34 further includes a second base plate 346, wherein a side of the second base plate 346 is connected to the sleeve 342 and the plurality of pillars 344 of the reinforcement portion. The second base plate 346 is embedded in the first base plate 324. Referring to FIG. 7, in the current embodiment, the ring 322 has an opening gap 323, wherein an end of the safety belt 200 is connected to or is mounted between the ring 322 and the sleeve 342, and the rest part of the safety belt 200 passes through the opening gap 323 and is wound around an outer peripheral surface of the ring 322.

In an embodiment, the first portion 32 is made of plastic material, and the second portion 34 is made of metal material. For example, in the current embodiment, the second portion 34 is made of steel, and the first portion 32 is made of engineering plastics. The method for manufacturing the safety belt base 30 could be a secondary covering buried injection molding, a metal-plastic hybrid injection molding, or etc. However, such method is not limited to the examples given above. For instance, the second portion 34 is fixed in a mold at first, and then the first portion 32 of the first base plate 324 and the ring 322 is formed by an injection molding, wherein the first base plate 324 and the ring 322 cover the second base plate 346 and the reinforcement portion of the second portion 34 respectively. With such design, both the reinforcement portion (such as the plurality of pillars 344) and the second base plate 346 support and reinforce a framework of the first portion 32. Therefore, the first portion 32 could be firmly engaged with the second portion 34 and could not be disengaged easily.

The decelerating member 40 has a perforation 42 and is fitted around the shaft 20 via the perforation 42 to be located in the sleeve 342. An outer peripheral surface of the decelerating member 40 has a plurality of friction surfaces 41 being in contact with an inner peripheral surface 340 of the sleeve 342. For instance, the plurality of friction surfaces 41 and the inner peripheral surface 340 are tight fit. Moreover, the decelerating member 40 further provides with a plurality of positioning holes 44.

The braking plate 50 has a central hole 52 which is adapted to connect to an end of the shaft 20. In the current embodiment, the central hole 52 is square in shape, and the end of the shaft 20 has a positioning portion 22, so that the positioning portion 22 is wedged in the central hole 52. Furthermore, the braking plate 50 further has a plurality of positioning holes 54. In an embodiment, a plurality of positioning members (such as a bolt) could be threaded through the positioning holes 54 of the braking plate 50 to be fixed in the positioning holes 44 of the decelerating member 40, so that the braking plate 50 could move synchronously with the decelerating member 40.

The braking assembly 60 includes a braking part 62 and a restoring spring 64, wherein the braking part 62 is pivotally disposed on the braking plate 50. An end of the restoring spring 64 is connected to an end of the braking part 62, while another end of the restoring spring 64 is connected to the braking plate 50. The restoring spring 64 provides an elastic force to urge the braking part 62 to normally stay at a restoring position, so that the braking part 62 isn't in contact with the frame 10. In the current embodiment, there are two sets of braking assembles 62 disposed on the braking plate 50.

The spiral spring 70 is disposed inside of the lateral cover 80, and an end 72 of the spiral spring 70 is connected to the shaft 20. For instance, in the current embodiment, the end 72 of the spiral spring 70 is connected to a groove 24 of the shaft 20, while another end 74 of the spiral spring 70 is engaged with the lateral cover 80. Both of the spiral spring 70 and the lateral cover 80 are connected to a side of the side plate (i.e., the side plate 122) which is oriented a direction away from the side plate 121.

The housing 90 is adapted to receive the frame 10, the shaft 20, the safety belt base 30, the decelerating member 40, the braking plate 50, the braking assembly 60, and etc. The housing 90, in the current embodiment, includes a first half portion 92 and a second half portion 94 which could be engaged with the first half portion 92.

With the aforementioned design, a first operating condition is defined when the user is in a safe condition (i.e., before the falling happens). For instance, the user walks on a place as a platform or a pallet as usual. Under the first operating condition, the braking assembly 60 is at the restoring position without being in contact with the blocking portion 125 of the frame 10. At this time, the braking plate 50 and the decelerating member 40 rotate coaxially along with the safety belt base 30 (i.e., both of the braking plate 50 and the decelerating member 40 rotate along with the safety belt base at the same time). When the safety belt 200 is pulled and unwrapped, for example, when the safety belt is pulled due to the user moves away from the fall protection device 100, the spiral spring 70 is stretched with the pulled safety belt 200 to provide a recovering force or an elastic force for recovering to its rolling form. While when the user approaches the fall protection device 100, a force which pulls the safety belt 200 becomes weak and is weaker than the elastic force of the spiral spring 70, so that the spiral spring 70 recovers to its rolling form and wraps or rolls the safety belt 200 back to the safety belt base 30.

Figure 6:
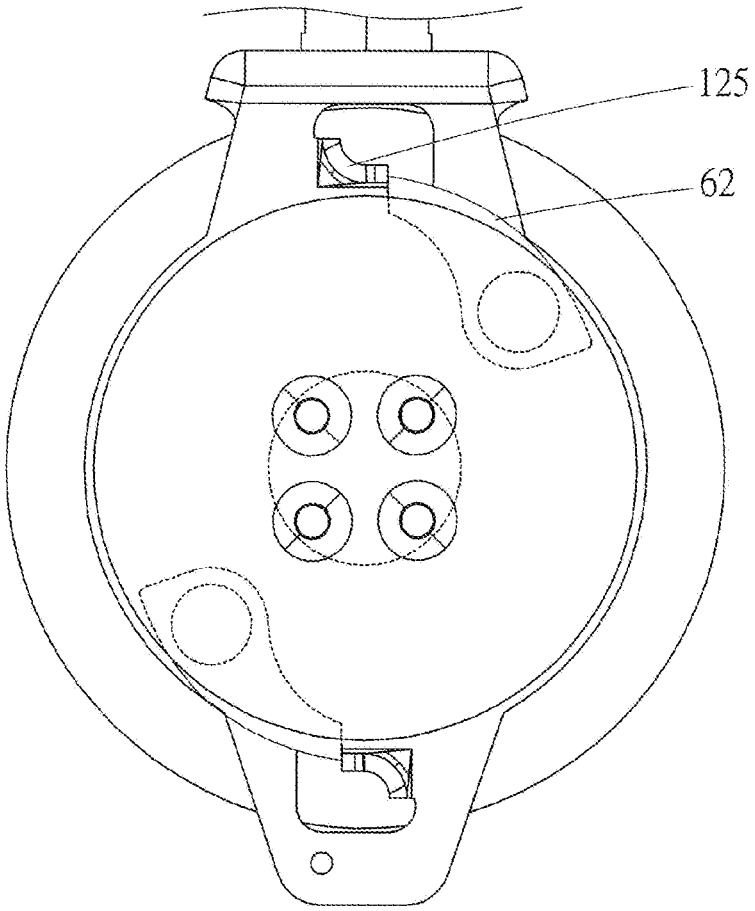
FIG. 6 is a schematic diagram, showing the breaking parts is forced to spin out to be abutted against the blocking portions respectively.

A condition when the safety belt 200 is pulled out rapidly is defined as a second operating condition. As shown in FIG. 6, under the second operating condition, the braking part 62 would be spun out by a torque or a centrifugal force which overcomes the elastic force of the restoring spring 64, so that the braking part 62 is abutted against the blocking portion 125, and braking plate 50 is then fixed. The decelerating member 40 fixed on the braking plate 50 is also fixed to be prevented from rotating. Referring to FIG. 7, pulling the safety belt 200 rotates the safety belt base 30 continuously. Since the inner peripheral surface 340 of the second portion 34 is conjugated with the friction surfaces 41 of the decelerating member 40, when the safety belt base 30 rotates relatively to the decelerating member 40, the friction surfaces 41 of the decelerating member 40 rubs the inner peripheral surface 340 to generate a rolling friction, thereby to slow down or limit the rotational speed of the safety belt base 30 and to further slowing down the unwound speed of the safety belt 200 and the falling speed of the user who is attached by the safety belt 200.

With the design of the first portion 32 and the second portion 34 of the safety belt base 30 of the present invention, the reinforcement portion of the second portion 34 is buried within the ring 322 of the first portion 32. Therefore, the second portion 34 and the first portion 32 could be engaged tightly. When the safety belt 200 bears a strong pulling force, the first portion 32 and the second portion 34 could be still firmly engaged and could be not breaking apart easily.

It must be pointed out that the embodiments described above are only some embodiments of the present invention. All equivalent structures which employ the concepts disclosed in this specification and the appended claims should fall within the scope of the present invention.

What is claimed is:

1. A fall protection device adapted to be connected to a safety belt; comprising:

a frame having a receiving place;

a shaft disposed on the frame;

a safety belt base which is fitted around the shaft and is located in the receiving place, including a first portion and a second portion, wherein the first portion has a ring, and the second portion has a reinforcement portion and a sleeve, which is surrounded by the ring and is adapted to be connected to the safety belt; the reinforcement portion is embedded within the ring; and wherein the first portion has a first base plate, and a side of the first base plate is connected to the ring; the second portion has a second base plate embedded in the first portion, wherein a side of the second base plate is connected to the sleeve and the reinforcement portion.

2. The fall protection device as claimed in claim 1, wherein the reinforcement portion comprises a plurality of pillars which are set at intervals and are embedded within the ring.

3. The fall protection device as claimed in claim 1, wherein the first portion is made of a plastic material, and the second portion is made of a metal material.

4. A safety belt base which is adapted to be disposed in a fall protection device; comprising:

a first portion which has a ring adapted to be wound by a safety belt; and a second portion having a sleeve and a reinforcement portion connected to the sleeve, wherein the sleeve is adapted to be connected to the safety belt and is surrounded by the ring, and the reinforcement portion is embedded within the ring; and wherein the first portion has a first base plate, and a side of the first base plate is connected to the ring; the second portion has a second base plate embedded in the first portion, wherein a side of the second base plate is connected to the sleeve and the reinforcement portion.

5. The fall protection device as claimed in claim 4, wherein the reinforcement portion comprises a plurality of pillars which are set at intervals and are embedded within the ring.

6. The fall protection device as claimed in claim 4, wherein the first portion is made of plastic material, and the second portion is made of metal material.

* * * * *